US008028360B2

(12) United States Patent
Regan et al.

(10) Patent No.: US 8,028,360 B2
(45) Date of Patent: Oct. 4, 2011

(54) BAFFLE BOX PILLOW

(75) Inventors: Laura A Regan, Seattle, WA (US); Ruth Brogan, Seattle, WA (US)

(73) Assignee: Pacific Coast Feather Company, Seattle, WA (US)

( * ) Notice: Subject to any disclaimer, the term of this patent is extended or adjusted under 35 U.S.C. 154(b) by 0 days.

(21) Appl. No.: 12/694,194

(22) Filed: Jan. 26, 2010

(65) Prior Publication Data

US 2011/0179576 A1 Jul. 28, 2011

(51) Int. Cl.
*A47G 9/00* (2006.01)

(52) U.S. Cl. ..... 5/645; 5/636; 5/490

(58) Field of Classification Search ..... 5/645, 636, 5/490, 502, 950, 952, 953
See application file for complete search history.

(56) References Cited

U.S. PATENT DOCUMENTS 4,426,945 A * 1/1984 A-Yan ..... 112/475.08
5,299,333 A * 4/1994 Pedersen et al. ..... 5/502
5,557,816 A * 9/1996 Pedersen et al. ..... 5/645
5,987,669 A * 11/1999 Leggett et al. ..... 5/502
7,045,191 B2 * 5/2006 Huntley ..... 428/137
2011/0047699 A1 * 3/2011 Regan et al. ..... 5/502
* cited by examiner

*Primary Examiner* — Robert G Santos
(74) *Attorney, Agent, or Firm* — Jensen & Puntigam, P.S.

(57) ABSTRACT

The pillow includes first and second fabric layers and third and fourth fabric layers, all of which are identical and secured together around the peripheries thereof. Positioned between the first and second fabric layers is a baffle structure which includes first and second lateral baffles extending across the width of the pillow and positioned at approximately one-third and two-thirds of the longitudinal distance (dimension) of the pillow. The baffle structure includes two central baffles, two first end baffles and two second end baffles, arranged to define baffle boxes of approximately equal size. The two central baffles extend longitudinally from one lateral baffle, leaving a space between the free ends thereof and the other lateral baffle to permit filling of the pillow. The first end baffles extend from the one lateral baffle a selected distance, leaving a space between the first end baffles and one lateral edge of the pillow to permit filling of the pillow. The second end baffles extend from the opposing lateral edge of the pillow toward the other lateral baffle, leaving a space between the second end baffles and the other lateral baffle to permit filling of the pillow.

7 Claims, 1 Drawing Sheet

BAFFLE BOX PILLOW

TECHNICAL FIELD

This invention relates generally to pillows, and more specifically concerns a pillow with an internal baffle structure.

BACKGROUND OF THE INVENTION

Pillows filled with small particulate material, such as feathers, down or fragments of foam material, while providing generally superior comfort, have the disadvantage of the fill shifting during use of the pillow, which can decrease comfort and/or support. Some pillows have used various baffle arrangements to reduce such shifting of the fill. An example of such a pillow is U.S. Pat. No. 7,562,405, which is owned by the assignee of the present invention. However, such pillow baffle structures are often limited because of the manufacturing requirement of fast and convenient blow-in of the fill, to completely fill the pillow, including around all the baffle members.

Accordingly, a pillow with a baffle structure which provides protection against shifting of the filling in use, while still being convenient to fill, is desirable.

DISCLOSURE OF THE INVENTION

Accordingly, the baffle box pillow, having lateral and longitudinal edges, comprises: first and second substantially identical fabric layers secured around the peripheries thereof to each other or to an intermediate gusset member; two lateral, substantially continuous, baffles which extend from one longitudinal edge of the pillow to the other longitudinal edge; at least one central baffle attached to one surface of one of the lateral baffles and extending toward the other lateral baffle, leaving a space for incoming fill between said one central baffle and the other lateral baffle; at least one first longitudinal end baffle extending longitudinally in a space between one lateral baffle and one lateral edge of the pillow and secured at one end thereof to either the one lateral baffle or the one lateral edge, leaving a space for incoming fill around the other end of the one first longitudinal end baffle; at least one second longitudinal end baffle extending longitudinally in a space between the other lateral baffle and the opposing lateral edge of the pillow, and secured at one end thereof to the other lateral baffle or the other lateral edge of the pillow, leaving a space for fill around the other end of the one second longitudinal end baffle; wherein the central baffle and the first and second longitudinal end baffles define a plurality of interior baffle boxes between the first and second fabric layers; and fill positioned between the first and second fabric layers in the baffle boxes.

BEST MODE FOR CARRYING OUT THE INVENTION

Figure 1:
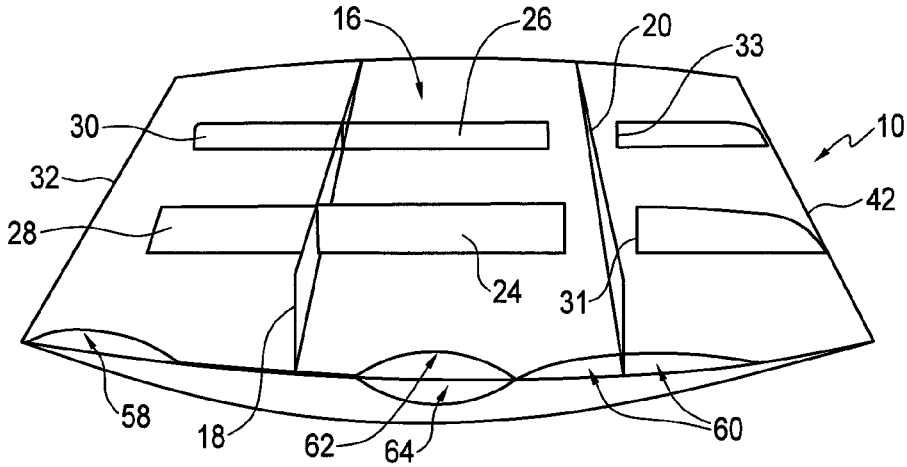
FIG. 1 is a perspective view of the pillow described herein including the openings for filling of the pillow.
Figure 2:
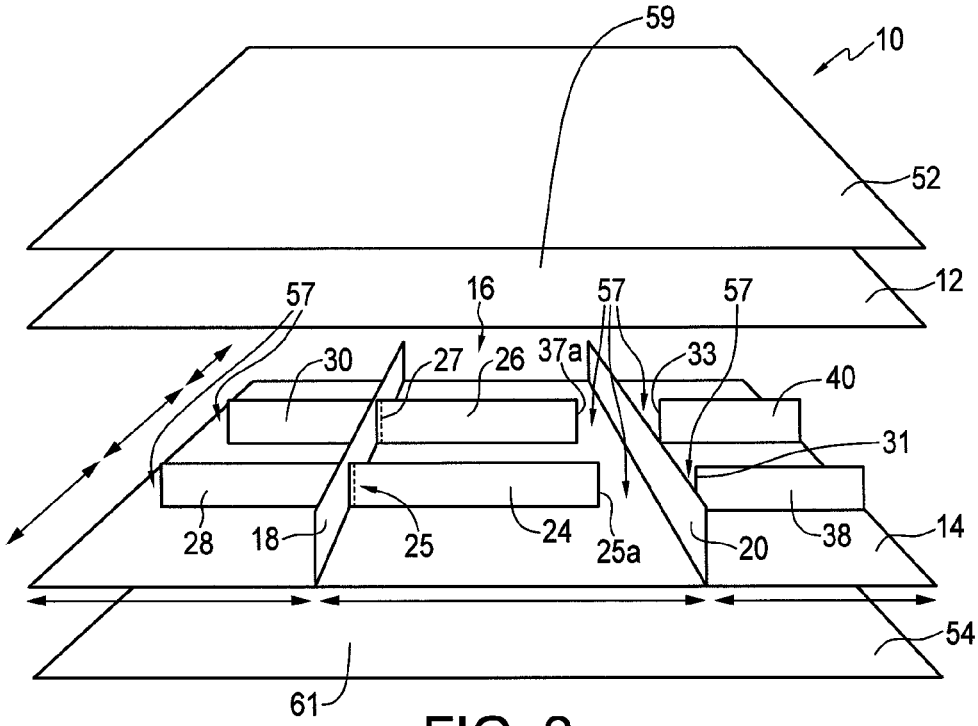
FIG. 2 is an exploded view of the pillow of FIG. 1.

FIGS. 1 and 2 show a bed pillow of conventional size having a particular internal baffle structure which limits the shifting of the pillow fill during use, while at the same time permitting convenient blowing in of fill in the manufacture of the pillow.

Figure 3:
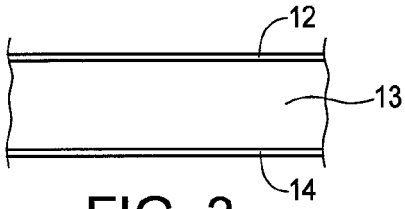
FIG. 3 is an elevational view of a portion of a modified arrangement of the pillow of FIGS. 1 and 2.

The pillow, shown generally at 10, includes first and second opposing fabric layers 12 and 14. Fabric layers 12 and 14 may be of any conventional pillow shell or tick material, such as cotton or polyester material. The first and second fabric layers are identical in size and configuration and may, be of various sizes, including, for instance, regular (twin) size, queen size or king size, or other size if so desired. As one example, for a queen-size pillow, the fabric layers 12 and 14 will be approximately 30 inches in the longitudinal direction and 20 inches in the lateral direction. The fabric layers 12 and 14 are secured together around the peripheries thereof or alternatively to an intermediate gusset member 13, as shown in FIG. 3.

A baffle structure is positioned between fabric layers 12 and 14. The baffle structure, shown generally at 16, includes a plurality of fabric strips, which can be of various materials, such as cotton or polyester. The fabric strips can be of various heights, such as approximately six inches in the embodiment shown. The height of the fabric strips may vary, however, typically within a range of four to eight inches. In the embodiment shown, baffle structure 16 divides the pillow into nine approximately equal size individual boxes. The baffle structure includes two lateral baffles 18 and 20 which extend generally for the full width of the pillow and are secured to the interior surfaces of first and second fabric layers 12 and 14. In the embodiment shown, the two lateral baffles 18 and 20 are spaced within the interior of the pillow at approximately the one-third and two-third points of the longitudinal distance of the pillow. While this is preferred, the position of the lateral baffles can also be varied to some extent. Baffles 18 and 20 are parallel in the embodiment shown and extend across the pillow at approximately 90° to the longitudinal edges (dimension) of the pillow.

The baffle structure 16 also includes a plurality of longitudinal baffles. The longitudinal baffles include two central baffles 24 and 26 which, in the embodiment shown, are attached by sewing or other suitable means at one end 25, 27 to lateral baffle 18, leaving a fill opening space between the other baffle ends 25*a*, 27*a* of lateral baffle 20. This arrangement could, however, be reversed, with the central baffles 24, 26 attached to lateral baffle 20. In the embodiment shown, the two central baffles 24, 26 are positioned at approximately the one-third and two-thirds points of the lateral dimension of the pillow, although again the position of the central baffles can be varied. Baffles 24, 26 in the embodiment shown are parallel and are arranged approximately 90° to the lateral baffles and the lateral edges (dimension) of the pillows.

The baffle structure 16 further includes first and second end baffles 28 and 30 which are in approximate longitudinal registry with central baffles 24 and 26 and extend from their attachment to lateral baffle 18, where they are typically sewn, to a point a small distance, i.e. approximately ⅛ inch, from the lateral edges 32 of fabric layers 12 and 14, i.e. the lateral edge of the pillow. The space between end baffles 28 and 30 and the lateral edges of the fabric layers permits fill to be blown into the interior of the pillow.

Baffle structure 16 further includes third and fourth end baffles 38 and 40 at the opposite end of the pillow, which in the embodiment shown are attached to and extend from the opposing lateral edges 42 of fabric layers 12 and 14, i.e. the lateral edge of the pillow 10 toward lateral baffle 20. End baffles 38 and 40 are also in approximate longitudinal registry with central baffles 24 and 26, but do not extend to lateral baffle 20, leaving a space (approximately ⅛ inch) between the ends 31 and 33 thereof and lateral baffle 20, again to permit convenient filling of the pillow. The longitudinal baffles are all attached to the fabric layers 12 and 14, by sewing or other means.

It should be understood that the attachment/position of end baffles 28 and 30 and end baffles 38 and 40 can be reversed from that shown, i.e. end baffles 38, 40 can be attached to the lateral edge of the pillow with the filling space for end baffles 28 and 30 between the free ends of baffles 28 and 30 and lateral baffle 18, while end baffles 38 and 40 can be attached to lateral baffle 30, with the filling space for end baffles 38, 40 being between the free ends of baffles 38, 40 and the lateral edge of the pillow.

All of the above described arrangements will result in nine individual baffle boxes, preferably of approximately equal size, although the position of the baffles can be varied to produce different size baffle boxes. In a modified arrangement, however, the two central baffles and the two end baffles on each side of the central baffles can be replaced with single baffles, typically, but not necessarily, in registry, thereby leading to a six-box baffle structure.

In manufacture, fabric layers 12 and 14 are initially sewn around their peripheries to leave two blow openings 58 and 60 (FIG. 1), through which filling is blown into the interior of the pillow, into all of the individual baffle boxes defined by the baffle structure 16 and fabric layers 12 and 14. In the embodiment shown, only the two openings 58 and 60, each approximately five inches long, are necessary to accomplish blowing in of the fill (arrows 57 in FIG. 2). When the filling process is done, the blow openings 58 and 60 are sewn closed. The fill will typically be feathers and down or a combination thereof, but could include particulate foam material, e.g. polyester fiber.

Pillow 10 can also include third and fourth (outer) fabric layers 52 and 54. Fabric layers 52 and 54 are substantially identical to fabric layers 12 and 14 and are typically made from the same material as those fabric layers. Fabric layers 52 and 54 are secured around their respective peripheries to fabric layers 12 and 14. This defines two outer chambers 59 and 61, between fabric layers 12 and 52 and fabric layers 14 and 54, respectively. Blow openings 62 and 64 are provided to fill the two outer chambers 59 and 61. When outer chambers 59 and 61 are filled, the blow openings 62 and 64 are sewn shut. The fill for outer chambers 58 and 60 can be feathers or down or a combination thereof. In addition, particulate foam, e.g. polyester fiber, can also be used, either by itself or in combination with feathers and/or down.

Accordingly, a new pillow structure has been disclosed which uses a particular baffle structure within a pillow shell or tick to prevent or limit shifting of the fill during use while permitting convenient filling of the pillow.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. A baffle box pillow, having lateral and longitudinal edges, comprising:

first and second substantially identical fabric layers secured around the peripheries thereof to each other or to an intermediate gusset member;

two lateral, substantially continuous, baffles which extend from one longitudinal edge of the pillow to the other longitudinal edge thereof;

two central baffles attached to one surface of one of the lateral baffles and extending toward the other lateral baffle, leaving a space for incoming fill between free ends of said two central baffles and the other lateral baffle;

two first longitudinal end baffles extending longitudinally in a space between the one lateral baffle and one lateral edge of the pillow, each secured at one end thereof, respectively, to the one lateral baffle, leaving a space for incoming fill between the other ends of the first longitudinal end baffles, respectively, and the one lateral edge of the pillow;

two second longitudinal end baffles extending longitudinally in a space between the other lateral baffle and the opposing lateral edge of the pillow, each secured at one end thereof, respectively, to the other lateral edge of the pillow, leaving a space for incoming fill between the other ends of the second longitudinal end baffles, respectively, and the other lateral baffle; wherein the central baffles and the first and second longitudinal end baffles define nine interior baffle boxes between the first and second fabric layers; and fill positioned between the first and second fabric layers in the baffle boxes.

2. The pillow of claim 1, wherein one first longitudinal end baffle, one central baffle and one second longitudinal end baffle are in longitudinal registry and wherein the other first longitudinal end baffle, the other central baffle and the other second longitudinal end baffle are also in longitudinal registry.

3. The pillow of claim 2, wherein the two lateral baffles and the two first longitudinal end baffles, the two central baffles and the two second longitudinal end baffles are positioned so as to define nine interior baffle boxes of approximately equal size within the interior of the pillow.

4. The pillow of claim 2, including third and fourth fabric layers, approximately identical in size and configuration to the first and second fabric layers, attached around their peripheries to the peripheries of the first and second fabric layers, and further including fill between the first and third fabric layers and between the second and fourth fabric layers.

5. The pillow of claim 4, wherein the fill is down, feathers, or a combination thereof.

6. The pillow of claim 5, wherein the fill includes particulate foam material.

7. The pillow of claim 6, wherein the fill is polyester fiber.

* * * * *